US009069282B2

(12) United States Patent
Isobe et al.

(10) Patent No.: US 9,069,282 B2
(45) Date of Patent: Jun. 30, 2015

(54) IMAGE FORMING APPARATUS TO DETECT AMOUNT OF REMAINING DEVELOPER

(71) Applicant: CANON KABUSHIKI KAISHA, Tokyo (JP)

(72) Inventors: Yuta Isobe, Kawasaki (JP); Hideo Kihara, Yokohama (JP); Takuya Kitamura, Yokohama (JP); Yuji Kawaguchi, Tokyo (JP); Kouki Yano, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 131 days.

(21) Appl. No.: 13/682,960

(22) Filed: Nov. 21, 2012

(65) Prior Publication Data

US 2013/0164001 A1 Jun. 27, 2013

(30) Foreign Application Priority Data

Dec. 21, 2011 (JP) ..... 2011-280096

(51) Int. Cl.
*G03G 15/08* (2006.01)

(52) U.S. Cl.
CPC ..... *G03G 15/0822* (2013.01); *G03G 15/086* (2013.01)

(58) Field of Classification Search
CPC ..... G03G 15/0822; G03G 15/086
USPC ..... 399/27, 28
See application file for complete search history.

(56) References Cited

U.S. PATENT DOCUMENTS

| | | | | |
|---|---|---|---|---|
| 8,699,894 | B2 * | 4/2014 | Kawata et al. | 399/27 |
| 2009/0317138 | A1 * | 12/2009 | Kawasaki et al. | 399/227 |
| 2011/0069978 | A1 * | 3/2011 | Yamamoto | 399/27 |
| 2013/0163999 | A1 * | 6/2013 | Isobe et al. | 399/12 |

FOREIGN PATENT DOCUMENTS

| | | | |
|---|---|---|---|
| JP | 2009-265282 | A | 11/2009 |
| JP | 2010-026497 | A | 2/2010 |

* cited by examiner

*Primary Examiner* — Rodney Bonnette
(74) *Attorney, Agent, or Firm* — Canon USA, Inc., IP Division

(57) ABSTRACT

An image forming apparatus includes an image bearing member, a developing device, a holding unit, and a detection device. The image bearing member supports an electrostatic latent image. The developing device includes a developer bearing member having a first electrode member and supporting a developer to develop the electrostatic latent image. The developing device includes a supply member having a second electrode member and supplying the developer to the developer bearing member at a nip portion. The holding unit holds and change the developing device to a first posture and to a second posture where the deposited developer falls off the first posture. The detection device detects a remaining developer amount in the developing device based on a capacitance C1 between the first and second electrode members in the first posture and a capacitance C2 between the first and second electrode members in the second posture.

19 Claims, 7 Drawing Sheets

FIRST ORIENTATION
(DEVELOPABLE ORIENTATION)

SECOND ORIENTATION

IMAGE FORMING APPARATUS TO DETECT AMOUNT OF REMAINING DEVELOPER

BACKGROUND OF THE INVENTION

1. Field of the Invention

The present invention relates to an image forming apparatus which includes a developing device including a toner bearing member and a toner supply member configured to supply toner to the toner bearing member, the image forming apparatus further including a detection unit configured to detect a capacitance between the toner bearing member and the toner supply member.

2. Description of the Related Art

There are methods for detecting the amount of toner remaining in a developing device used in an image forming apparatus such as an electrophotographic apparatus. Among those is a capacitance detection method which includes detecting a capacitance between two electrodes arranged inside the developing device to obtain information about the amount of the remaining developer.

In particular, when using a developing device that includes a developing roller serving as a toner bearing member and a supply roller including a foam layer serving as a toner supply member, a detection method discussed in Japanese Patent Application Laid-Open No. 2009-265282 may be used. The detection method includes detecting a capacitance between a core of the developing roller and a core of the supply roller to obtain information about the amount of remaining toner.

Such a method can measure the amount of remaining toner by detecting the capacitance between the cores because the amount of the remaining toner in the developing device and the capacitance are correlated with each other. To accurately detect the amount of the remaining toner, the method discussed in Japanese Patent Application Laid-Open No. 2009-265282 includes rotating the supply roller at predetermined speed for a predetermined time before the detection of the capacitance, thereby stabilizing the amount of the toner in the foam layer.

According to the method discussed in Japanese Patent Application Laid-Open No. 2009-265282, the supply roller is to be rotated for a predetermined time to detect the remaining amount. This imposes an extra load on the toner as much as the supply roller is driven, which can promote toner degradation.

SUMMARY OF THE INVENTION

The present invention is directed to an image forming apparatus that detects an amount of remaining toner based on a capacitance between an electrode member of a toner bearing member and an electrode member of a toner supply member, and that can accurately detect the amount of the remaining toner and reduce toner degradation.

According to an aspect of the present invention, an image forming apparatus image includes an image bearing member configured to support an electrostatic latent image, a developing device including a developer bearing member and a supply member, wherein the developer bearing member includes a first electrode member and is configured to support a developer to develop the electrostatic latent image, and wherein the supply member includes a second electrode member and is configured to supply the developer to the developer bearing member at a nip portion between the supply member and the developer bearing member, a holding unit configured to hold and change the developing device to a first posture and to a second posture in which the developer deposited on the nip portion in the first posture falls off, and a detection device configured to detect an amount of a remaining developer in the developing device based on a first capacitance C1 between the first electrode member and the second electrode member in the first posture and a second capacitance C2 between the first electrode member and the second electrode member in the second posture.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

The following exemplary embodiments describe the present invention by way of examples. The scope of an exemplary embodiment is not limited to the dimensions, materials, shapes, or relative arrangement of the components described below unless otherwise specified.

Figure 1:
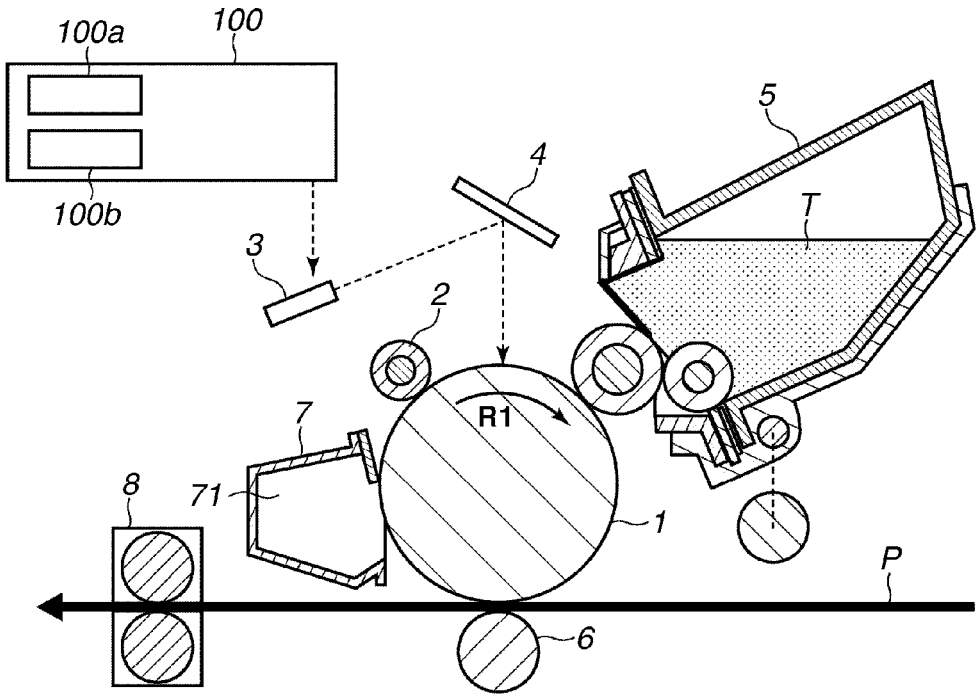
FIG. 1 is a schematic sectional view illustrating an example of an image forming apparatus to which an exemplary embodiment is applied.

A first exemplary embodiment will be described. FIG. 1 is a schematic diagram illustrating a general configuration of an image forming apparatus according to the present exemplary embodiment. This image forming apparatus is a monochromatic image forming apparatus using electrophotographic processes. The image forming apparatus forms an image on a sheet-like recording material P serving as a recording medium based on an electrical image signal input from a host apparatus to a controller unit 100. Examples of the host apparatus include an image reader (document image reading apparatus), a personal computer, and a facsimile.

The image forming apparatus includes a rotating drum type electrophotographic photosensitive member (hereinafter, referred to as a drum) 1 as an image bearing member which bears an electrostatic latent image on its surface. The image forming apparatus further includes a charging unit 2, an image exposure unit 3, a developing device 5, a transfer unit 6, a drum cleaning unit 7, and a fixing unit 8 as process units that act on the drum 1.

The drum 1 rotationally drives about a drum axis in a clockwise direction indicated by the arrow R1 at predetermined speed. The charging unit 2 uniformly charges the surface of the drum 1 to a predetermined polarity (in the present exemplary embodiment, negative polarity) and potential. In the present exemplary embodiment, a contact charging roller is used as the charging unit 2. The image exposure unit 3 forms an electrostatic latent image on the surface of the drum 1 via a mirror 4. In the present exemplary embodiment, a laser scanner unit is used as the image exposure unit 3. The developing device 5 is a unit that visualizes the electrostatic latent image formed on the drum surface into a developer image (toner image).

In the present exemplary embodiment, the developing device 5 is a reversal developing device of contact developing type which uses negatively chargeable nonmagnetic toner as a developer T. The transfer unit 6 transfers the toner image visualized on the drum surface to a recording material P serving as a transfer material. A transfer roller is used as the transfer unit 6. The drum cleaning unit 7 removes transfer residual toner from the surface of the drum 1 after transfer. A cleaning blade is used as the drum cleaning unit 7. The toner removed from the drum surface is stored in a cleaner container 71. The recording material P with the transferred toner image is guided into the fixing unit 8, and heated and pressed by a fixing nip portion. The toner image is thereby fixed to the recording material P.

Completing an image forming job on one sheet or a continuous plurality of sheets, the controller unit 100 puts the image forming apparatus into a standby state and waits for the input of a next image formation start signal. Specifically, the controller unit 100 stops driving the drum 1, the laser scanner unit 3, and the transfer unit 6.

Figure 2A:
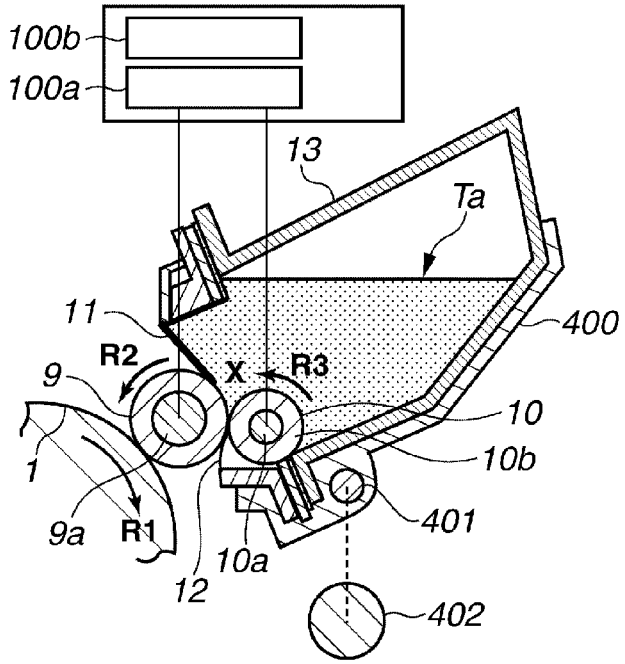
FIGS. 2A and 2B are schematic sectional views illustrating an example of a developing device to which an exemplary embodiment is applied, FIG. 2A illustrating a state where the developing device is held in a first posture, FIG. 2B illustrating a state where the developing device is held in a second posture.

The developing device 5 will be described. FIG. 2A is a schematic enlarged view of the developing device 5 in a developable first posture. The posture may reflect a relative disposition or attitude of something or the parts of something, such as the developing device 5. The developing device 5 is detachably mounted on a mount 400 of the image forming apparatus main body. The mount 400 functions as a holding unit that holds and changes the developing device 5 to the first posture illustrated in FIG. 2A and a second posture illustrated in FIG. 2B. The mount 400 is swung about a shaft 401 by a driving unit 402 under the control of the controller unit 100. Examples of the driving unit 402 include a gear mechanism using a forward reverse motor, an electromagnetic solenoid mechanism, and a rack and pinion mechanism.

The developing device 5 includes a toner container 13, a developing roller 9, and a supply roller 10. The toner container 13 contains toner T. The developing roller 9 serves as a toner bearing member for developing an electrostatic image formed on the drum 1. The supply roller 10 serves as a toner supply member which makes contact with the developing roller 9 to supply the toner T. The developing device 5 further includes a regulation blade 11 and a leak prevention seal 12. The regulation blade 11 serves as a layer thickness regulation member which regulates the thickness of the toner layer on the developing roller 9. The leak prevention seal 12 prevents leakage of the toner T from a gap between the developing roller 9 and the toner container 13.

The toner container 13 is an oblong container whose longitudinal direction is in the axial direction of the drum 1. The toner container 13 has an opening in its lower portion. The opening is opposed to the drum 1 along the longitudinal direction of the toner container 13. The developing roller 9 is located in the opening and arranged in parallel to the longitudinal direction of the toner container 13. The developing roller 9 is rotatably supported by the toner container 13 via bearing members (not illustrated) that are respectively attached to both longitudinal ends of the toner container 13. The supply roller 10 is arranged inside the toner container 13 in parallel with the developing roller 9, on the other side of the developing roller 9 from where the developing roller 9 is opposed to the drum 1. The supply roller 10 is rotatably supported by the toner container 13 via bearing members (not illustrated) that are respectively attached to both longitudinal ends of the toner container 13.

In the present exemplary embedment, the developing roller 9 has a diameter of ϕ 13. The developing roller 9 includes a ϕ 8 conductive core (first electrode member) 9*a* which is covered with a base layer of silicon rubber and further coated with acrylic urethane rubber. The developing roller 9 has a volume resistance of $10^4$ to $10^{12}$ Ω·cm.

The supply roller 10 is a ϕ 15 urethane sponge roller, including a ϕ 6 conductive core (second electrode member) 10*a* covered with a urethane sponge layer 10*b* serving as a foam layer of open-cell foam. The urethane sponge layer 10*b* has a volume resistance of around $10^4$ to $10^{12}$ Ω·cm. The distance (center distance) between the core 9*a* of the developing roller 9 and the core 10*a* of the supply roller 10 is 13 mm. The urethane sponge layer 10*b* of the supply roller 10 intrudes into the surface of the developing roller 9 by 1.0 mm.

The regulation blade 11 is a flexible member made of phosphor bronze or urethane rubber. The extremity of the regulation blade 11 slides over the developing roller 9 to form the toner T applied to the developing roller 9 into a thin coating layer. The regulation blade 11 is arranged on the toner container 13 with its base fixed to the upper edge of the opening.

The leak prevention seal 12 is a flexible member whose extremity is in contact with the developing roller 9 to cover a gap between a lower portion of the developing roller 9 and the toner container 13, thereby preventing leakage of the toner T. The leak prevention seal 12 is arranged on the toner container 13 with its base fixed to the lower edge of the opening.

In the present exemplary embodiment, the developing device 5 in the first posture is opposed to the drum 1 in an upright position with the top side of the toner container 13 upward and the bottom side downward. The developing roller 9 of such a developing device 5 is in contact with the drum 1. The developing roller 9 in contact with the drum 1 develops an electrostatic latent image formed on the drum 1. In other words, the developing device 5 uses a contact developing method.

When performing image formation, driving force and a developing bias are input to the developing device 5 in the first posture from a driving unit (not illustrated) and a power supply unit on the main body side of the image formation apparatus. The developing roller 9 rotationally drives at predetermined speed in a counterclockwise direction indicated by the arrow R2 in FIG. 2A. Accordingly, the rotational direction of the developing roller 9 at the drum contact portion is forward direction with respect to the rotational direction R1 of the drum 1. The supply roller 10 which makes contact with the developing roller 9 to supply the toner T to the developing roller 9 rotationally drives at predetermined speed in a counterclockwise direction indicated by the arrow R3. Accordingly, the rotational direction of the supply roller 10 at the contact portion with the developing roller 9 is reverse direction (in a counter direction) with respect to the rotational direction R2 of the developing roller 9.

The rotating supply roller 10 applies the toner T to the periphery of the rotating developing roller 9. The regulation blade 11 forms the applied toner T into a thin coating layer. The thin layer of the toner T is conveyed to a development position by the subsequent rotation of the developing roller 9, and applied to the surface of the drum 1. A developing bias power supply unit applies a predetermined developing bias (a direct-current (DC) voltage in the present exemplary embodiment) to the developing roller 9. As a result, the thin layer of the toner T on the periphery of the phase roller 9 is selectively transferred to the drum surface according to the electrostatic latent image on the drum surface. The electrostatic latent image is thereby developed as a toner image. The toner T not provided for the development of the electrostatic latent image is conveyed back into the toner container 13 by the subsequent rotation of the developing roller 9. The supply roller 10 removes the toner T from the surface of the developing roller 9 and applies the toner T again to the surface of the developing roller 9. Such an operation is repeated to develop the electrostatic latent image on the drum surface.

As described above, the developing device 5 in the first posture is in an upright position. By gravity, the toner T in the toner container 13 lies vertically below in the lower portion of the toner container 13 (container bottom side) where the supply roller 10 is arranged. The toner T stored in the toner container 13 has a toner surface (developer surface) Ta. In the first posture, the toner T is deposited up to above the contact portion (nip portion) between the developing roller 9 and the supply roller 10 (the area X in the diagram). In such a posture, the developing device 5 can supply the toner T to the supply roller 10. As a result, the toner T can be applied to the developing roller 9.

A method for detecting the amount of remaining toner in the developing unit will be described. The remaining amount has conventionally been detected by determining a capacitance between the supply roller and the developing roller in one posture. To detect the amount of the remaining toner with high accuracy, the supply roller has been rotated at predetermined speed for a predetermined time to stabilize the amount of toner in the foam layer before the detection of the capacitance. Since the supply roller is to be rotated for a predetermined time to detect the remaining amount, the toner undergoes an extra load as much as the supply roller is driven, which can promote toner degradation.

In view of the foregoing, in the present exemplary embodiment, the amount of the remaining toner T in the developing device 5 is detected based on a difference between a capacitance C1 in the developable first posture and a capacitance C2 in the second posture where the toner T deposited on the contact portion between the developing roller 9 and the supply roller 10 in the first posture is let fallen off. The result of detection C1 depends on both the amount of the toner T in the supply roller 10 and the amount of the toner T in the area X. On the contrary, the result of detection C2 depends only on the amount of the toner T in the supply roller 10. A difference between C1 and C2 can thus be determined to eliminate the effect of the amount of the toner T in the supply roller 10 and detect the amount of the toner T in the area X.

Next, the method for detecting the remaining amount will be described. The amount of the toner T remaining in the developing device 5 is detected by a remaining amount detection device 100*a*. As illustrated in FIG. 2A, in the developable first posture, the remaining amount detection device 100*a* applies an alternating-current bias to the conductive core 10*a* of the supply roller 10 and detects a voltage inducted on the conductive core 9*a* of the developing roller 9 to detect the capacitance. The controller unit 100 then changes the developing device 5 to the second posture illustrated in FIG. 2B. In the second posture, the remaining amount detection device 100*a* detects the capacitance between the core 10*a* of the supply roller 10 and the core 9*a* of the developing roller 9. The capacitances are measured by using an inductance-capacitance-resistance (LCR) meter ZM2354 from NF Corporation.

Figure 3:
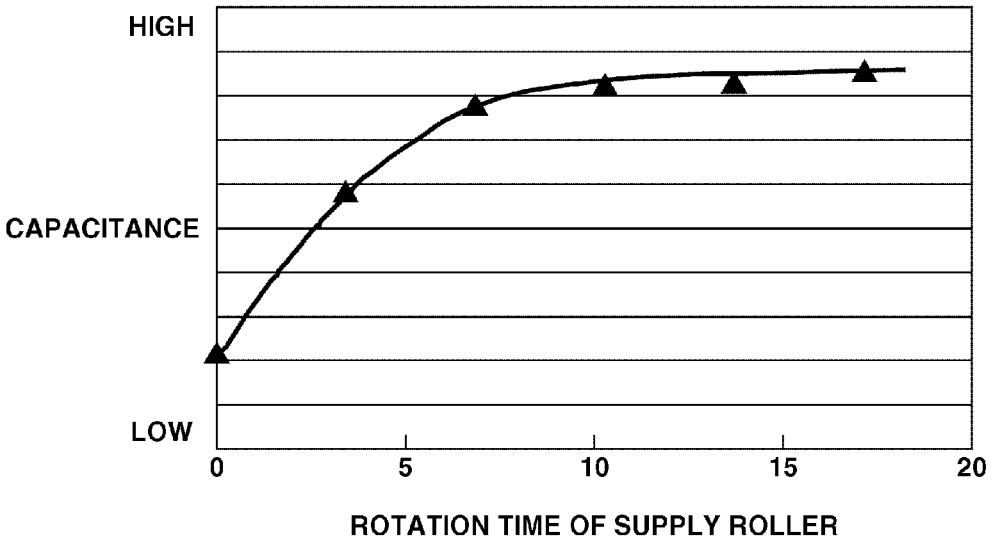
FIG. 3 is a chart illustrating the relationship between the rotation time of a supply roller and a capacitance.

Next, the relationship between the rotation time of the supply roller 10 and the capacitance will be described. As illustrated in FIG. 2A, when the supply roller 10 lying below the toner surface Ta is rotated, the urethane sponge layer 10*b* bears the toner T. In the present exemplary embodiment, the supply roller 10 is rotated at a speed of 150 rpm. As illustrated in FIG. 3, it is found to take approximately 10 seconds for the supply roller 10 to sufficiently bear or otherwise hold or support the toner T and reach an equilibrium state. As discussed in Japanese Patent Application Laid-Open No. 2009-265282, it takes longer to reach the equilibrium state if the supply roller 10 is rotated at lower speed.

Figure 4:
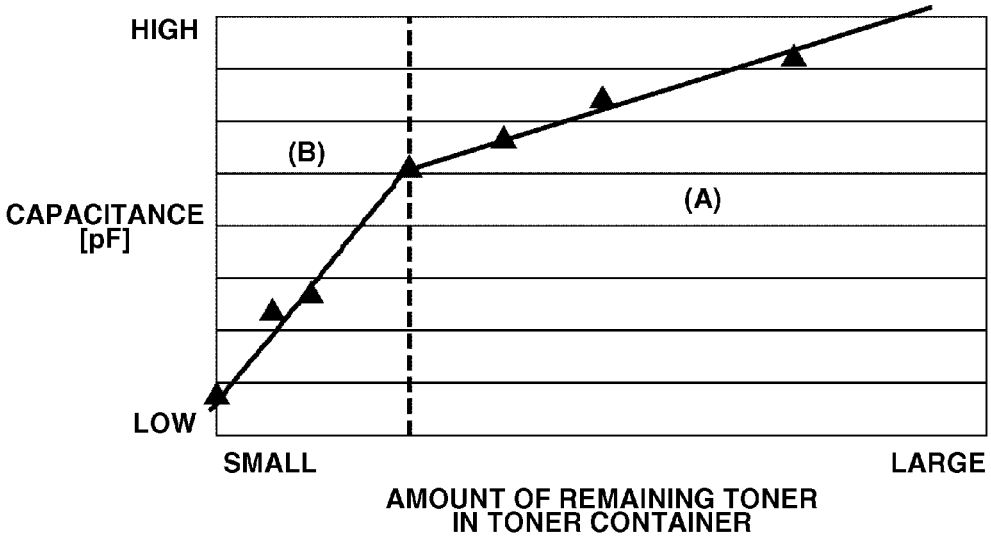
FIG. 4 is a chart illustrating the relationship between the amount of toner in a toner container and a capacitance.

Next, the correlation between the amount of the toner T in the area X and the capacitance in the first posture will be described. While repeating a print job, the toner T in the area X is agitated to maintain a constant density. Changes of the capacitance and the amount of the toner T in the toner container 13 were measured in the first posture when the toner T in the area X maintained a constant density. To prevent a change in the amount of the toner T in the supply roller 10, the supply roller 10 was not rotated during the measurement of the capacitance. FIG. 4 illustrates the result. In addition to the capacitance measurements, the area X was observed for the state of the toner T. As illustrated in FIG. 4, the capacitance and the amount of the toner T have two linear relationships depending on the amount of the toner T in the toner container 13. When the toner container 13 contains a sufficient amount of toner T (the area A in the chart), the area X is filled with a sufficient amount of toner T. The capacitance therefore does not decrease much even if the amount of the toner T in the toner container 13 decreases to lower the toner surface Ta. If the amount of the toner T in the toner container 13 decreases further (the area B in the chart) and the toner surface Ta falls below the peak point of the supply roller 10, the amount of the toner T in the area X decreases. As the amount of the toner T in the area X decreases, the capacitance decreases sharply. This shows that the amount of the toner T in the area X and the capacitance are correlated with each other.

Figure 2B:
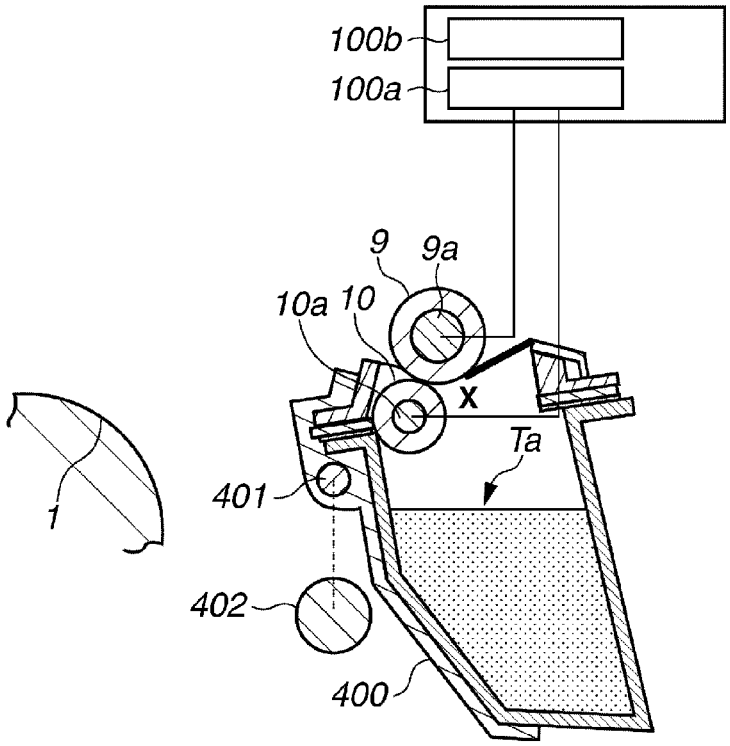
Figure 5:
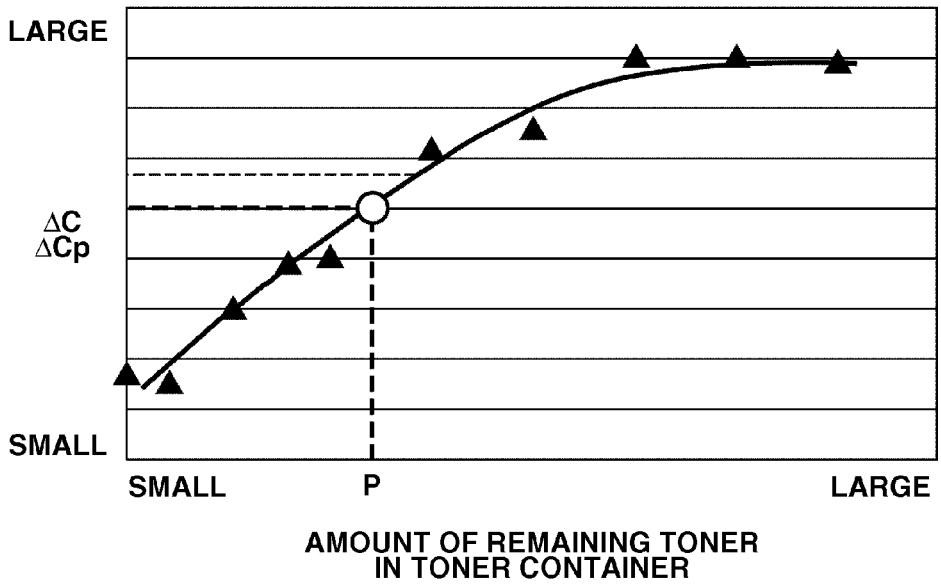
FIG. 5 is a chart illustrating the relationship between the amount of the toner in the toner container and a difference in capacitance.

Next, the method for detecting the remaining amount will be described in detail with reference to FIGS. 2A and 2B. The developing device 5 can be changed to the upright position serving as the developable first posture like FIG. 2A and an inverted position serving as the second posture like FIG. 2B. The toner T deposited on the contact portion between the developing roller 9 and the supply roller 10 in the first posture falls off in the second posture, and thereby the area X becomes a state having no toner as illustrated in FIG. 2B. Initially, in the first posture, the remaining amount detection device 100*a* applies a toner remaining amount detecting bias from the bias power supply to the conductive core 10*a* of the supply roller 10. An alternating-current bias with a frequency of 5 kHz and a voltage of Vpp=200 V is used as the toner remaining amount detecting bias. The application of the toner remaining amount detecting bias induces a voltage on the conductive core 9*a* of the developing roller 9. The voltage is detected by a detector and rectified by a detection circuit, whereby the capacitance C1 is detected. Next, the developing device 5 is changed from the first posture to the second posture. In the second posture, the remaining amount detection device 100*a* similarly detects the capacitance C2. A difference between the detected capacitances C1 and C2 (|C1-C2|) will be denoted by ΔC. FIG. 5 illustrates the relationship between ΔC and the amount of the remaining toner Tin the developing device 5. ΔC decreases with the amount of the toner T in the toner container 13. Using such a relationship, the remaining amount detection device 100*a* detects the amount of the remaining toner T based on ΔC. In the present exemplary embodiment, when the amount of the remaining toner T decreases, it becomes no longer possible at a point P in FIG. 5 to maintain sufficient image quality. The remaining amount detection device 100*a* sets ΔCp at the point P as a threshold to determine that there is no toner. If the remaining amount detection device 100*a* detects that there is no toner, the controller unit 100 makes a display unit 100*b* execute a warning display of a "no toner".

While in the present exemplary embodiment, the amount of the remaining toner T is indicated by executing a warning display of the "no toner", the amount of the remaining toner T may be displayed in terms of the remaining number of sheets capable of image formation. A display for prompting the user to replace the development device 5 may be made.

In the present exemplary embodiment, the amount of the remaining toner T is detected based on a difference between the capacitances C1 and C2. However, the amount of the remaining toner T may be detected based on a ratio between the capacitances C1 and C2. For example, the remaining amount detection device 100*a* may determine that there is "no toner" and may execute warning display if C2/C1 exceeds a threshold. The remaining amount detection device 100*a* can thus detect the amount of the remaining toner T based on a comparison between the capacitances C1 and C2.

Figure 6:
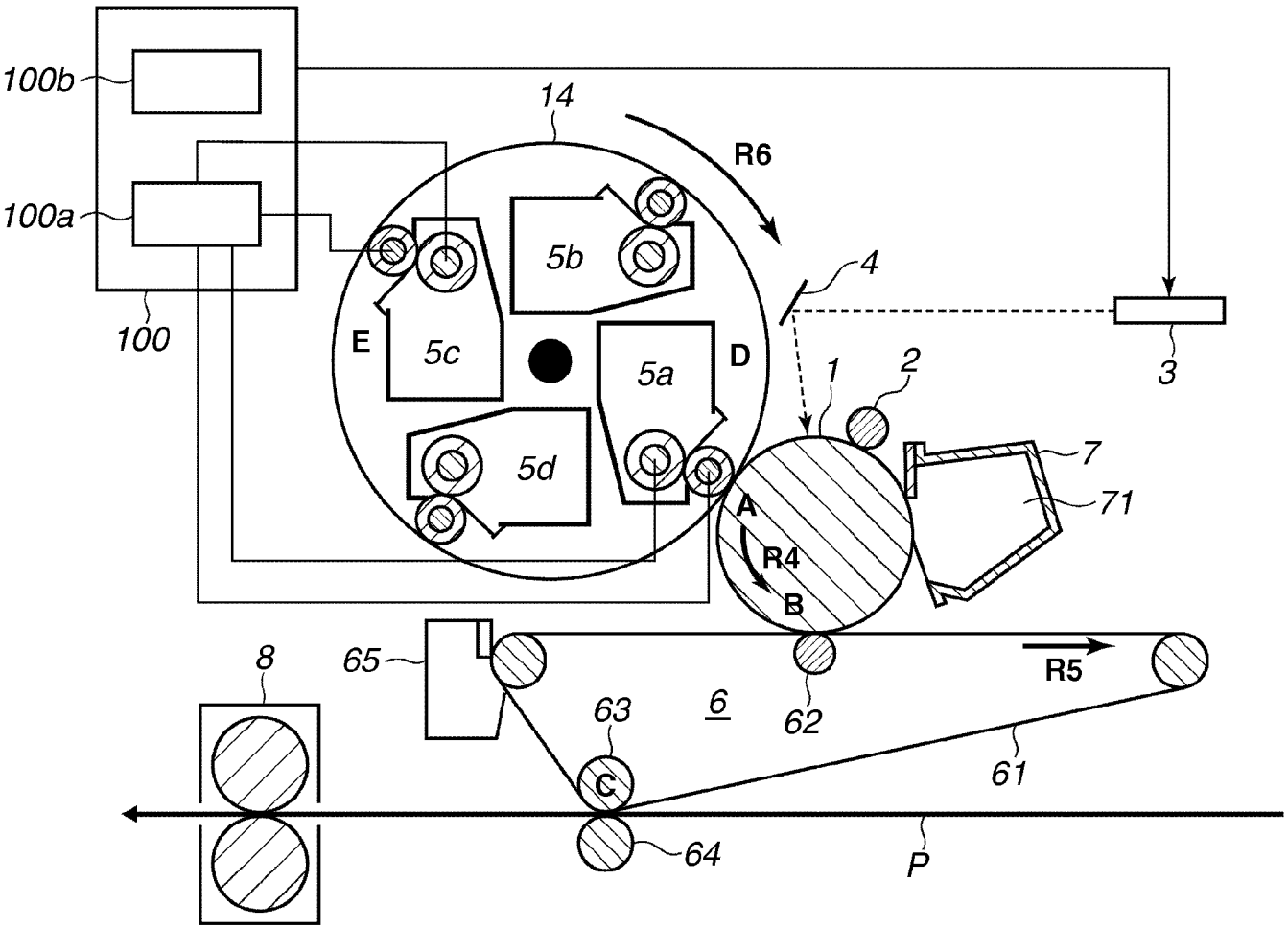
FIG. 6 is a schematic sectional view illustrating an example of a full color image forming apparatus to which an exemplary embodiment is applied.

A second exemplary embodiment will be described. FIG. 6 is a schematic diagram illustrating a general configuration of an image forming apparatus according to the second exemplary embodiment. This image forming apparatus is a four-color full color image forming apparatus using electrophotographic processes. The image forming apparatus includes a rotating drum type electrophotographic photosensitive member (hereinafter, referred to as a drum) 1. The image forming apparatus further includes a charging unit 2, an image exposure unit 3, developing devices 5 (5*a*, 5*b*, 5*c*, and 5*d*), a transfer unit 6, a drum cleaning unit 7, and a fixing unit 8 as process units that act on the drum 1.

The image forming apparatus according to the second exemplary embodiment includes the plurality of developing devices 5 serving as developing units. More specifically, the image forming apparatus includes first to fourth four developing devices 5. A rotary 14 serving as a holding unit holds the plurality of developing devices 5. The rotary 14 is rotatably supported and can rotate and move a desired developing device 5 (for example, the developing device 5*a*) to a development position A where the developing device 5 is opposed to and makes contact with the photosensitive drum 1.

The image forming apparatus further includes a transfer belt 61 as an intermediate transfer member. The transfer belt 61 is rotatably arranged being suspended by a plurality of rollers. The photosensitive drum 1 and the transfer belt 61 are pressed against and make contact with each other in a primary transfer position B, where a primary transfer roller 62 is arranged to sandwich the transfer belt 61 between the photosensitive drum 1 and the primary transfer roller 62. A toner image formed in the development position A is transferred to the transfer belt 61 in the primary transfer position B. A recording material P and the transfer belt 61 are pressed against and make contact with each other in a secondary transfer position C, where a secondary transfer counter roller 63 and a secondary roller 64 are arranged. The secondary transfer counter roller 63 is arranged to suspend the transfer belt 61. The secondary transfer roller 64 is configured to be able to come into contact with and separate from the transfer belt 61. A transfer cleaning device 65 is arranged downstream of the secondary transfer position C in the moving direction of the transfer belt 61. The transfer cleaning device 65 is arranged in contact with the transfer belt 61 so that a blade attached to the transfer cleaning apparatus 65 can scrape toner off the transfer belt 61.

Next, an operation for forming a four-color full color image will be described. The photosensitive drum 1 rotationally drives in the direction of the arrow R4 at predetermined speed. The charging unit 2 uniformly charges the drum surface to a predetermined potential. The image exposure unit 3 and a reflection mirror 4 form an electrostatic latent image on the drum surface according to an image signal of each color. A developing device 5 develops the formed electrostatic latent image in the development position A to form a toner image.

The developing device 5 to be located in the development position A is determined according to the color-specific image signals. The rotary 14 is rotated in the direction of the arrow R6 in advance to locate a developing device 5 of desired color in the development position A. Toner images are developed in fixed color order. In the present exemplary embodiment, toner images are formed in the order of yellow, magenta cyan, and black. The toner image formed on the drum 1 is transferred to the transfer belt 61 in the primary transfer position B. Formed toner images are successively superposed on previously transferred ones to form a full color toner image on the intermediate transfer belt 61. The secondary transfer roller 64 and the transfer cleaning device 65 are separated from the transfer belt 61 until the formation of a full color toner image, and are brought into contact with the transfer belt 61 after the formation. A recording material P is conveyed in time with the timing at which the formed full color toner image reaches the secondary transfer position C. The secondary transfer roller 64 and the secondary transfer counter roller 63 sandwich the recording material P and the transfer belt 61 together to transfer the full color toner image to the recording material P. The recording material P with the transferred full color toner image is conveyed to the fixing unit 8. The fixing unit 8 applies heat and pressure to the full color toner image on the recording material P, thereby fixing the full color toner image to the recording material P as a final image.

Next, a method for detecting the amount of remaining toner according to the present exemplary embodiment will be described with reference to FIG. 6. The following description deals with the method for detecting the amount of remaining toner in the developing device 5*a*. The method can be similarly performed on the not-mentioned developing devices (5*b*, 5*c*, and 5*d*). The amount of the remaining toner in the developing device 5*a* is detected by a remaining amount detection device 100*a*. In FIG. 6, the developing device 5*a* is held in a developable position D. The developing device 5*a* in the position D is in a first posture similar to that of the first exemplary embodiment. In such a state, the remaining amount detection device 100*a* changes switches (not illustrated) to make contact only with the developing device 5*a* in the position D. The remaining amount detection device 100*a* then detects a capacitance C1*y* of the developing device 5*a* in the first posture. Subsequently, the rotary 14 is driven to rotate and hold the developing device 5*a* in position E. The development device 5*a* in the position E is in a second posture similar to that of the first exemplary embodiment. In such as state, the remaining amount detection device 100*a* changes switches to make contact only with the developing device 5*a* in the position E. The remaining amount detection device 100*a* then detects a capacitance C2*y* of the developing device 5*a* in the second posture. The remaining amount detection device 100*a* determines a difference between the detected C1*y* and C2*y*, and compares the difference with a threshold ΔCp' to determine whether there is no toner.

Figure 7:
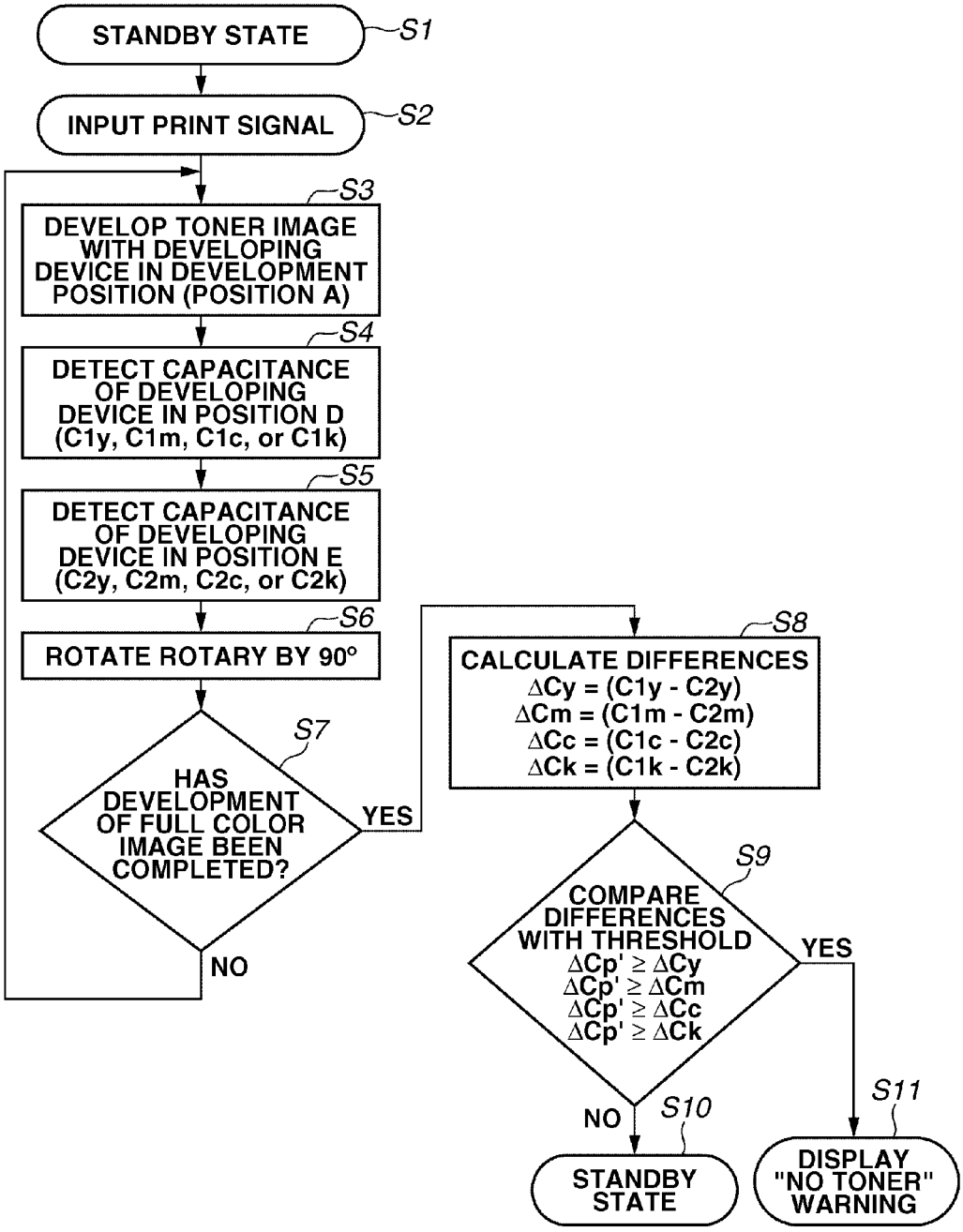
FIG. 7 is a flowchart illustrating detection of the amount of a remaining developer according to a second exemplary embodiment.

Next, a method for detecting the amount of remaining toner during an image forming operation will be described with reference to the flowchart of FIG. 7. In step S1, the image forming apparatus is in a standby state. In step S2, a host apparatus inputs a print signal to the image forming apparatus. In step S3, the image forming apparatus starts an image forming operation, and performs developing with yellow (Y) color toner. In step S4, after the end of the developing operation with the Y color toner, the remaining amount detection device 100*a* detects the capacitance C1*y* of the Y color developing device 5*a* lying in the first posture in the position D. In step S5, the remaining amount detection device 100*a* detects the capacitance C2*c* of the cyan (C) color developing device 5*c* lying in the second posture in the position E. In step S6, the rotary 14 is driven to rotate by 90°. The magenta (M) color developing device 5*b* is thereby held in the position D in the first posture, and the black (K) color developing device 5*d* is held in the position E in the second posture. In step S7, the image forming apparatus similarly repeats development and capacitance detection on the developing devices (NO in step S7). After the end of the development of a four-color full color image (YES in step S7), then in step S8, the remaining amount detection device 100*a* calculates differences between the capacitances in the first posture and the capacitances in the second posture of the respective developing devices 5*a*, 5*b*, 5*c*, and 5*d*. In step S9, the remaining amount detection device 100*a* compares the differences (ΔCy, ΔCm, ΔCc, and ΔCk) of the capacitances of the respective developing devices 5*a*, 5*b*, 5*c*, and 5*d* with the threshold ΔCp'. If all the developing devices 5*a*, 5*b*, 5*c*, and 5*d* have a sufficient amount of remaining toner (NO in step S9), then in step S10, the image forming apparatus ends the print operation and enters the standby state. If there is a developing device determined to be no toner (YES in step S9), then in step S11, the image forming apparatus performs warning display of a "no toner" on the display unit 100*b* of an operation unit.

In the present exemplary embodiment, the amounts of the remaining toners are indicated by performing warning display of a "no toner". However, the amounts of the remaining toners may be displayed in terms of the remaining number of sheets capable of image formation. A display for prompting the user to replace the developing device(s) 5 may be made.

In the present exemplary embodiment, the amounts of the remaining toners are detected after development. However, the amounts of the remaining toners may be detected before development.

In the present exemplary embodiment, the amount of the remaining toner is detected based on difference between the capacitance C1, and the capacitance C2. However, the amount of the remaining toner may be detected based on ratio between the capacitance C and the capacitance C2. For example, the remaining amount detection device 100*a* may determine that there is "no toner" and may perform warning display if C2/C1 exceeds a threshold. The remaining amount detection device 100*a* can thus detect the amount of the remaining toner based on a comparison between the capacitance C1 and the capacitance C2.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-280096 filed Dec. 21, 2011, which is hereby incorporated by reference herein in its entirety.

What is claimed is:

1. An image forming apparatus comprising:

an image bearing member configured to bear an electrostatic latent image;

a developing device including a developer bearing member and a supply member, wherein the developer bearing member includes a first electrode member and is configured to develop the electrostatic latent image, and wherein the supply member includes a second electrode member and is configured to supply a developer to the developer bearing member at a nip portion between the supply member and the developer bearing member;

a holding unit configured to hold and change the developing device to a first posture in which the developer is deposited on the nip portion and to a second posture in which the developer deposited on the nip portion in the first posture falls off; and a detection device configured to detect an amount of remaining developer in the developing device based on a first capacitance C1 between the first electrode member and the second electrode member in the first posture and a second capacitance C2 between the first electrode member and the second electrode member in the second posture.

2. The image forming apparatus according to claim 1, wherein the detection device is configured to detect the amount of remaining developer based on a difference between the first capacitance C1 and the second capacitance C2.

3. The image forming apparatus according to claim 1, wherein the detection device is configured to detect the amount of remaining developer based on a ratio between the first capacitance C1 and the second capacitance C2.

4. The image forming apparatus according to claim 1, wherein the supply member includes a foam layer on a surface of the supply member.

5. The image forming apparatus according to claim 1, wherein the detection device is configured to detect the first capacitance C1 and the second capacitance C2 while not forming an image.

6. The image forming apparatus according to claim 1, further comprising a plurality of developing devices, wherein the holding unit is configured to hold the plurality of developing devices and rotate to change each developing device of the plurality of developing devices to the first posture and to the second posture.

7. The image forming apparatus according to claim 1, further comprising a display unit configured to display a result of detection by the detection device.

8. An image forming apparatus to which a developing device is detachably attached, wherein the developing device includes a developer bearing member and a supply member, wherein the developer bearing member includes a first electrode member and is configured to develop an electrostatic latent image borne by an image bearing member, and wherein the supply member includes a second electrode member and is configured to supply a developer to the developer bearing member at a nip portion between the supply member and the developer bearing member, the image forming apparatus comprising:

a holding unit configured to hold and change the developing device to a first posture in which the developer is deposited on the nip portion and to a second posture in which the developer deposited on the nip portion in the first posture falls off; and a detection device configured to detect an amount of remaining developer in the developing device based on a first capacitance C1 between the first electrode member and the second electrode member in the first posture and a second capacitance C2 between the first electrode member and the second electrode member in the second posture.

9. The image forming apparatus according to claim 8, wherein the detection device is configured to detect the amount of remaining developer based on a difference between the first capacitance C1 and the second capacitance C2.

10. The image forming apparatus according to claim 8, wherein the detection device is configured to detect the amount of remaining developer based on a ratio between the first capacitance C1 and the second capacitance C2.

11. The image forming apparatus according to claim 8, wherein the supply member includes a foam layer on a surface of the supply member.

12. The image forming apparatus according to claim 8, wherein the detection device is configured to detect the first capacitance C1 and the second capacitance C2 while not forming an image.

13. The image forming apparatus according to claim 8, further comprising a plurality of developing devices, wherein the holding unit is configured to hold the plurality of developing devices and rotate to change each developing device of the plurality of developing devices to the first posture and to the second posture.

14. The image forming apparatus according to claim 8, further comprising a display unit configured to display a result of detection by the detection device.

15. An image forming apparatus comprising:

an image bearing member configured to bear an electrostatic latent image;

a developing device including a first electrode member and a second electrode member, wherein the developing device is configured to store a developer and use the stored developer to develop the electrostatic latent image;

a holding unit configured to hold and change the developing device to a first posture in which the developer is deposited on the first electrode and the second electrode and to a second posture in which the developer deposited on the first electrode and the second electrode in the first posture falls off; and a detection device configured to detect an amount of remaining developer in the developing device based on a first capacitance C1 between the first electrode member and the second electrode member in the first posture and a second capacitance C2 between the first electrode member and the second electrode member in the second posture.

16. The image forming apparatus according to claim 15, wherein the detection device is configured to detect the first capacitance C1 and the second capacitance C2 while not forming an image.

17. The image forming apparatus according to claim 15, further comprising a plurality of developing devices, wherein the holding unit is configured to hold the plurality of developing devices and rotate to change each developing device of the plurality of developing devices to the first posture and to the second the posture.

18. An image forming apparatus comprising:

an image bearing member configured to bear an electrostatic latent image;

a developing device including a first electrode member and a second electrode member, wherein the developing device is configured to store a developer and use the stored developer to develop the electrostatic latent image;

a holding unit configured to hold and change the developing device to a first posture and to a second posture; and a detection device configured to detect an amount of remaining developer in the developing device based on a first capacitance C1 between the first electrode member and the second electrode member in the first posture and a second capacitance C2 between the first electrode member and the second electrode member in the second posture, wherein the detection device is configured to detect the amount of remaining developer based on a difference between the first capacitance C1 and the second capacitance C2.

19. An image forming apparatus comprising:

an image bearing member configured to bear an electrostatic latent image;

a developing device including a first electrode member and a second electrode member, wherein the developing device is configured to store a developer and use the stored developer to develop the electrostatic latent image;

a holding unit configured to hold and change the developing device to a first posture and to a second posture; and a detection device configured to detect an amount of remaining developer in the developing device based on a first capacitance C1 between the first electrode member and the second electrode member in the first posture and a second capacitance C2 between the first electrode member and the second electrode member in the second posture, wherein the detection device is configured to detect the amount of remaining developer based on a ratio between the first capacitance C1 and the second capacitance C2.

* * * * *